US010114302B2

(12) United States Patent
Takahashi et al.

(10) Patent No.: US 10,114,302 B2
(45) Date of Patent: Oct. 30, 2018

(54) PHOTOCONDUCTOR, IMAGE FORMING APPARATUS, AND PROCESS CARTRIDGE

(71) Applicants: Ryohta Takahashi, Shizuoka (JP); Akihiro Sugino, Shizuoka (JP); Eiji Kurimoto, Shizuoka (JP); Hidetoshi Kami, Shizuoka (JP); Keisuke Shimoyama, Shizuoka (JP); Tetsuro Suzuki, Shizuoka (JP); Tomoharu Asano, Kanagawa (JP); Toshihiro Ishida, Shizuoka (JP)

(72) Inventors: Ryohta Takahashi, Shizuoka (JP); Akihiro Sugino, Shizuoka (JP); Eiji Kurimoto, Shizuoka (JP); Hidetoshi Kami, Shizuoka (JP); Keisuke Shimoyama, Shizuoka (JP); Tetsuro Suzuki, Shizuoka (JP); Tomoharu Asano, Kanagawa (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/590,047

(22) Filed: May 9, 2017

(65) Prior Publication Data

US 2017/0343908 A1 Nov. 30, 2017

(30) Foreign Application Priority Data

May 30, 2016 (JP) ..... 2016-107128

(51) Int. Cl.
*G03G 5/00* (2006.01)
*G03G 5/05* (2006.01)
(Continued)

(52) U.S. Cl.
CPC ..... *G03G 5/051* (2013.01); *G03G 5/0521* (2013.01); *G03G 5/14708* (2013.01); *G03G 15/01* (2013.01); *G03G 15/20* (2013.01)

(58) Field of Classification Search
CPC ..... G03G 5/051; G03G 5/0521
(Continued)

(56) References Cited

U.S. PATENT DOCUMENTS 4,672,149 A 6/1987 Yoshikawa et al.
5,350,653 A 9/1994 Shoshi et al.
(Continued)

FOREIGN PATENT DOCUMENTS

JP 8-166679 6/1996
JP 11-133649 5/1999
(Continued)

OTHER PUBLICATIONS

U.S. Appl. No. 08/862,260, filed May 23, 1997.
U.S. Appl. No. 08/562,154, filed Nov. 22, 1995.

*Primary Examiner* — Mark A Chapman
(74) *Attorney, Agent, or Firm* — Oblon, McClelland, Maier & Neustadt, L.L.P.

(57) ABSTRACT

A photoconductor is provided. The photoconductor includes a support, an undercoat layer overlying the support, and a photosensitive layer overlying the undercoat layer. The undercoat layer includes a binder resin and a zinc oxide particle. The photosensitive layer includes a compound represented by the following formula (1):
(Continued)

Formula (1)

where each of $R^1$ and $R^2$ independently represents an alkyl group or an aromatic hydrocarbon group.

8 Claims, 3 Drawing Sheets

(51) Int. Cl.
*G03G 5/147* (2006.01)
*G03G 15/01* (2006.01)
*G03G 15/20* (2006.01)

(58) Field of Classification Search
USPC ..... 430/76
See application file for complete search history.

(56) References Cited

U.S. PATENT DOCUMENTS

| | | | |
|---|---|---|---|
| 5,387,487 | A | 2/1995 | Shoshi et al. |
| 5,486,438 | A | 1/1996 | Shoshi et al. |
| 5,492,784 | A | 2/1996 | Yoshikawa et al. |
| 5,578,405 | A | 11/1996 | Ikegami et al. |
| 5,723,243 | A | 3/1998 | Sasaki et al. |
| 5,747,204 | A | 5/1998 | Anzai et al. |
| 5,840,454 | A | 11/1998 | Nagai et al. |
| 2005/0221210 | A1 | 10/2005 | Suzuki et al. |
| 2005/0287452 | A1 | 12/2005 | Tamura et al. |
| 2006/0014096 | A1 | 1/2006 | Ohshima et al. |
| 2006/0068308 | A1 | 3/2006 | Ohshima et al. |
| 2006/0093955 | A1 | 5/2006 | Ohshima et al. |
| 2006/0199092 | A1 | 9/2006 | Sugino et al. |
| 2007/0009818 | A1 | 1/2007 | Yanagawa et al. |
| 2007/0031746 | A1 | 2/2007 | Toshine et al. |
| 2007/0212626 | A1 | 9/2007 | Toshine et al. |
| 2007/0212627 | A1 | 9/2007 | Yanagawa et al. |
| 2008/0085459 | A1 | 4/2008 | Kami et al. |
| 2008/0199217 | A1 | 8/2008 | Iwamoto et al. |
| 2008/0220356 | A1* | 9/2008 | Yamada ..... G03G 5/051 430/69 |
| 2008/0304867 | A1 | 12/2008 | Nagai et al. |
| 2008/0305426 | A1 | 12/2008 | Kurimoto et al. |
| 2010/0178074 | A1 | 7/2010 | Nakatake et al. |
| 2010/0209842 | A1 | 8/2010 | Yanagawa et al. |
| 2010/0233602 | A1 | 9/2010 | Yamamoto et al. |
| 2013/0022902 | A1 | 1/2013 | Shimoyama et al. |
| 2013/0330104 | A1 | 12/2013 | Shimoyama et al. |
| 2016/0139517 | A1 | 5/2016 | Ishida et al. |
| 2016/0161871 | A1 | 6/2016 | Asano et al. |
| 2016/0274475 | A1 | 9/2016 | Eguchi et al. |
| 2016/0334720 | A1 | 11/2016 | Ishida et al. |

FOREIGN PATENT DOCUMENTS

| | | |
|---|---|---|
| JP | 2006-030700 | 2/2006 |
| JP | 2007-271962 | 10/2007 |
| JP | 2008-250149 | 10/2008 |
| JP | 2010-164639 | 7/2010 |
| JP | 2011-095476 | 5/2011 |
| JP | 2012-058597 | 3/2012 |
| JP | 2013-041259 | 2/2013 |
| JP | 2014-013379 | 1/2014 |
| JP | 2015-022101 | 2/2015 |

* cited by examiner

PHOTOCONDUCTOR, IMAGE FORMING APPARATUS, AND PROCESS CARTRIDGE

CROSS-REFERENCE TO RELATED APPLICATIONS

This patent application is based on and claims priority pursuant to 35 U.S.C. § 119(a) to Japanese Patent Application No. 2016-107128, filed on May 30, 2016, in the Japan Patent Office, the entire disclosure of which is hereby incorporated by reference herein.

BACKGROUND

Technical Field

The present disclosure relates to a photoconductor, an image forming apparatus, and a process cartridge.

Description of the Related Art

In electrophotography, an image is formed by exposing a photoconductor to a series of processes including charging, irradiation, developing, and transfer. In particular, organic photoconductors that use organic materials are widely used in electrophotography lately for their advantage in flexibility, thermal stability, and film formation property.

Among various types of organic photoconductors, function-separated multi-layer photoconductors are now the mainstream. A function-separated multi-layer photoconductor generally includes a conductive support, a charge generation layer containing a charge generation material, and a charge transport layer containing a charge transport material. The charge generation layer and the charge transport material are laminated on the conductive support. The charge generation layer and the charge transport layer serve as photosensitive layers. In particular, a number of negatively-chargeable photoconductors have been proposed that includes: a charge generation layer dispersing an organic pigment as a charge generation material in a vapor-deposited layer or a resin layer; and a charge transport layer dispersing an organic low-molecular-weight compound as a charge transport material in a resin layer. A technique of providing an undercoat layer between a conductive support and a photosensitive layer has also been proposed for suppressing charge injection from the conductive support.

SUMMARY

In accordance with some embodiments of the present invention, a photoconductor is provided. The photoconductor includes a support, an undercoat layer overlying the support, and a photosensitive layer overlying the undercoat layer. The undercoat layer includes a binder resin and a zinc oxide particle. The photosensitive layer includes a compound represented by the following formula (1):

Formula (1)

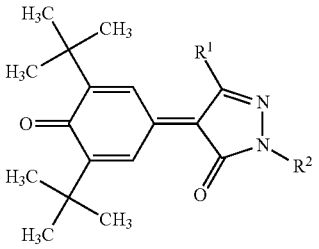

where each of $R^1$ and $R^2$ independently represents an alkyl group or an aromatic hydrocarbon group.

In accordance with some embodiments of the present invention, an image forming apparatus is provided. The image forming apparatus includes the above photoconductor, a charger, an irradiator, a developing device, and a transfer device. The charger is configured to charge a surface of the photoconductor. The irradiator is configured to irradiate the charged surface of the photoconductor with light to form an electrostatic latent image thereon. The developing device is configured to develop the electrostatic latent image into a toner image. The transfer device is configured to transfer the toner image onto a recording medium.

In accordance with some embodiments of the present invention, a process cartridge is provided. The process cartridge includes the above photoconductor and at least one of the above charger, irradiator, developing device, and transfer device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
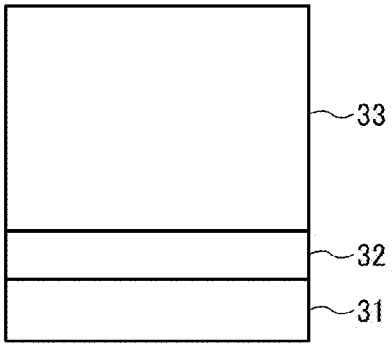
FIG. 1 is a cross-sectional view of a photoconductor according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

Within the context of the present disclosure, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

Organic photoconductors are now required to be more durable and stable in accordance with the rapid progress of electrophotographic image forming apparatus technologies in terms of colorization, speeding up, and higher definition. On the other hand, as an organic photoconductor is repeatedly exposed to charging and neutralization processes in electrophotography, organic materials included in the organic photoconductor will be gradually deteriorated by continuous exposure to an electrostatic load, thus causing charge trapping or a charge property change. This results in deterioration of the organic photoconductor in terms of electrophotographic properties.

If the charge property is decreased as the organic photoconductor deteriorates, the output image quality will be adversely affected. For example, the image density is decreased, background fog is generated, and/or the continuously-produced images become non-homogeneous.

Possible factors for the occurrence of charge property decrease include a poor ability of the undercoat layer and a deterioration of the undercoat layer after repeated use. Generally, the undercoat layer is required to achieve and maintain a good balance between a function of preventing charge injection from the support into the photosensitive layer (hereinafter "charge injection prevention function") and a function of transporting charges generated in the photosensitive layer to the support (hereinafter "charge transport function"). However, it is very difficult to achieve and maintain a good balance between the charge injection prevention function and the charge transport function because organic materials in the undercoat layer will be deteriorated by continuous exposure to an electrostatic load.

It is especially difficult for photoconductors to maintain electric properties and image quality for an extended period of time in strict environment conditions, such as high-temperature high-humidity environments (for example, having a temperature of 27° C. and a relative humidity of 80%) and low-temperature low-humidity environments (for example, having a temperature of 10° C. and a relative humidity of 15%).

In view of this situation, one object of the present invention to provide a photoconductor that reliably provides stable electric properties and image quality for an extended period of time even in high-temperature high-humidity environments or low-temperature low-humidity environments.

In accordance with some embodiments of the present invention, a photoconductor is provided that reliably provides stable electric properties and image quality for an extended period of time even in high-temperature high-humidity environments or low-temperature low-humidity environments.

A photoconductor according to an embodiment of the present invention includes a support, an undercoat layer overlying the support, and a photosensitive layer overlying the undercoat layer. The undercoat layer includes a binder resin and a zinc oxide particle. The photosensitive layer includes a compound represented by the following formula (1).

Formula (1)

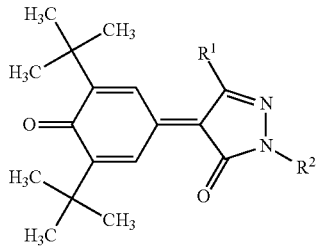

In the formula (1), each of $R^1$ and $R^2$ independently represents an alkyl group or an aromatic hydrocarbon group. As the photosensitive layer is irradiated with light, charges are generated in the photosensitive layer. The charges are then injected into the undercoat layer first and thereafter into the support. If the charges accumulate on the interface between the undercoat layer and the support, an abnormal image (e.g., residual image) will be generated.

When the undercoat layer includes a zinc oxide particle and the photosensitive layer includes the compound represented by the formula (1), it is considered that holes and electrons generated in the photosensitive layer can easily transfer to the undercoat layer in accordance with the energy levels specific to each material, without accumulating on the interface therebetween. Thus, generation of an abnormal image (e.g., residual image) can be suppressed.

FIG. 1 is a cross-sectional view of a photoconductor according to an embodiment of the present invention. This photoconductor includes a support 31, an undercoat layer 32 overlying the support 31, and a photosensitive layer 33 overlying the undercoat layer 32. The photosensitive layer 33 includes a charge generation material and a charge transport material as main ingredients.

Figure 2:
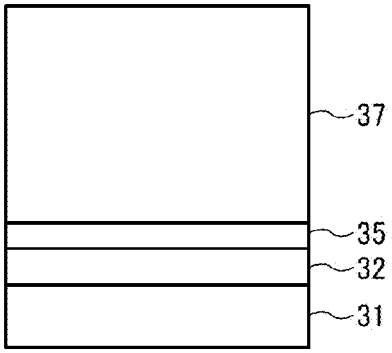
FIG. 2 is a cross-sectional view of a photoconductor according to another embodiment of the present invention.

FIG. 2 is a cross-sectional view of a photoconductor according to another embodiment of the present invention. This photoconductor includes a support 31, an undercoat layer 32 overlying the support 31, a charge generation layer 35 overlying the undercoat layer 32, and a charge transport layer 37 overlying the charge generation layer 35. The charge generation layer 35 includes a charge generation material as a main ingredient. The charge transport layer 37 includes a charge transport material as a main ingredient.

Figure 3:
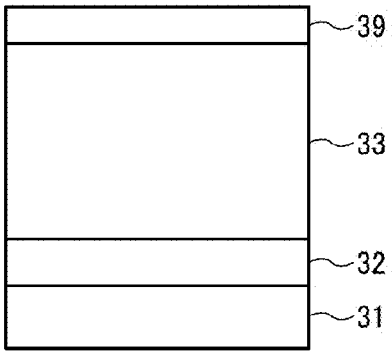
FIG. 3 is a cross-sectional view of a photoconductor according to another embodiment of the present invention.

FIG. 3 is a cross-sectional view of a photoconductor according to another embodiment of the present invention. This photoconductor includes a support 31, an undercoat layer 32 overlying the support 31, a photosensitive layer 33 overlying the undercoat layer 32, and a protective layer 39 on the outermost surface of the photoconductor. The photosensitive layer 33 includes a charge generation material and a charge transport material as main ingredients.

Figure 4:
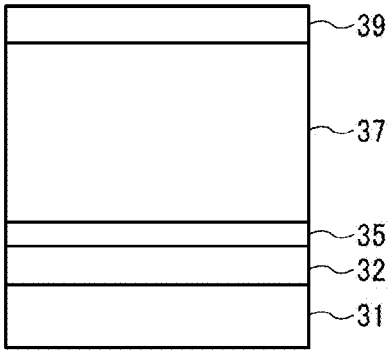
FIG. 4 is a cross-sectional view of a photoconductor according to another embodiment of the present invention.

FIG. 4 is a cross-sectional view of a photoconductor according to another embodiment of the present invention. This photoconductor includes a support 31, an undercoat layer 32 overlying the support 31, a charge generation layer 35 overlying the undercoat layer 32, a charge transport layer 37 overlying the charge generation layer 35, and a protective layer 39 on the outermost surface of the photoconductor. The charge generation layer 35 includes a charge generation material as a main ingredient. The charge transport layer 37 includes a charge transport material as a main ingredient.

Support

The support 31 may be made of a conductive material having a volume resistivity not greater than $10^{10}$ Ω·cm. Examples of such a conductive material include: plastic films, plastic cylinders, and paper sheets, on the surface of which a metal (e.g., aluminum, nickel, chromium, nichrome, copper, gold, silver, platinum) or a metal oxide (e.g., tin oxide, indium oxide) is deposited or sputtered; metal plates (e.g., aluminum, aluminum alloy, nickel, stainless steel); and metal cylinders prepared by tubing a metal plate by extrusion or drawing and processing the surface of the tube by cutting, super finishing, and polishing. In addition, an endless nickel belt and an endless stainless steel belt can also be used as the support 31.

The above-described supports may be further coated with a conductive layer dispersing conductive powder in a binder resin. Specific examples of the conductive powder include, but are not limited to, carbon black, acetylene black, powders of metals such as aluminum, nickel, iron, nichrome, copper, zinc, and silver, and powders of metal oxides such as conductive tin oxides and ITO (indium tin oxide). Specific examples of the binder resin include, but are not limited to, thermoplastic, thermosetting, and photocurable resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. The conductive layer can be formed by applying a coating liquid dispersing or dissolving the conductive powder and the binder resin in a solvent (e.g., tetrahydrofuran, dichloromethane, methyl ethyl ketone, toluene), on the support.

Examples of the support 31 further include cylindrical supports coated with a heat-shrinkable tube, as a conductive layer, made of polyvinyl chloride, polypropylene, polyester, polystyrene, polyvinylidene chloride, polyethylene, chlorinated rubber, or TEFLON (trademark) further dispersing a conductive material therein.

Undercoat Layer

The undercoat layer 32 includes a binder resin and a zinc oxide particle, and optionally includes other components, if necessary.

Preferably, the undercoat layer has a function of suppressing injection of unnecessary charges (i.e., charges having a polarity opposite to the charging polarity of the photoconductor) from the support into the photosensitive layer, and another function for transporting charges generated in the photosensitive layer which have the same polarity as the charging polarity of the photoconductor. For example, in a case in which the photoconductor is negatively chargeable in an image forming process, the undercoat layer is generally required to have a function of preventing injection of positive holes from the support into the photosensitive layer (hereinafter "hole blocking property") and another function of transporting electrons from the photosensitive layer to the support (hereinafter "electron transportability"). To reliably and stably provide electric properties and image quality for an extended period of time even in high-temperature high-humidity environments or low-temperature low-humidity environments, the photoconductor is generally required to maintain the hole blocking property and the electron transportability constant even when exposed to continuous electrostatic loads (i.e., repeated charging and neutralization) regardless of temperature and humidity conditions.

The undercoat layer includes a zinc oxide particle that has a proper volume resistivity (powder resistivity) and dispersibility.

Preferably, the zinc oxide particle has a volume resistivity of from $10^2$ to $10^{11}$ Ω·cm.

When the volume resistivity is $10^2$ Ω·cm or more, the undercoat layer is improved in charge injection prevention function, thereby providing a sufficient leakage resistance without causing abnormal images such as background fog. When the volume resistivity is $10^{11}$ Ω·cm or less, charges are sufficiently transported from the photosensitive layer to the support, thereby suppressing a decrease in light decay property and an increase in residual potential.

Zinc Oxide Particle

As the zinc oxide particle included in the undercoat layer, commercially-available zinc oxide particles can be used.

Preferably, the zinc oxide particle has an average particle diameter of from 20 to 200 nm. As the average particle diameter of the zinc oxide particle becomes larger, the number of zinc oxide particles in the undercoat layer becomes relatively smaller; and as the average particle diameter of the zinc oxide particle becomes smaller, the number of zinc oxide particles in the undercoat layer becomes relatively larger. When the number of zinc oxide particles in the undercoat layer is too small, the distance between the particles is increased. This makes it difficult for negative charges generated from the charge generation material in the photosensitive layer to reach the support. As a result, charge trapping is likely to occur, causing abnormal images such as residual image. When the number of zinc oxide particles in the undercoat layer is too large, charge leakage is likely to occur, causing background fog. When the average particle diameter of the zinc oxide particle is within the range of from 20 to 200 nm, the number of zinc oxide particles in the undercoat layer becomes proper and the above-described problems can be avoided.

The average particle diameter of the zinc oxide particle can be a volume average particle diameter that can be determined by observing 100 randomly-selected zinc oxide particles in the undercoat layer with a transmission electron microscope (TEM), measuring the projected areas of the particles, calculating circle-equivalent diameters of the projected areas, and calculating a volume average particle diameter from the circle-equivalent diameters.

Volume Occupancy of Zinc Oxide Particle in Undercoat Layer

Preferably, the volume occupancy of the zinc oxide particle in the undercoat layer is in the range of from 40% to 55%, more preferably from 45% to 53%. When the volume occupancy is 40% or more, the volume resistivity of the undercoat layer is not excessively increased. Electric properties of the undercoat layer can be maintained at a proper level. When the volume occupancy is 55% or less, the zinc oxide particles are finely dispersed in the undercoat layer to improve transmittivity of the layer, providing background fog resistance.

The volume occupancy of the zinc oxide particle is calculated from the content and specific weight of each component, i.e., the zinc oxide particle, the binder resin, and an optional component, if any, in the undercoat layer.

Binder Resin

As the binder resin, thermoplastic resins and thermosetting resins can be used. Two or more resins can be used in combination. Preferably, the binder resin of the undercoat layer includes a resin having a high resistance to organic solvents, because the undercoat layer is to be coated with a photosensitive layer. Specific examples of such highly-solvent-resistant resins include, but are not limited to, water-soluble resins such as polyvinyl alcohol, casein, and sodium polyacrylate; alcohol-soluble resins such as copolymerized nylon and methoxymethylated nylon; curable resins capable of forming a three-dimensional network structure, such as polyurethane, melamine resin, phenol resin, alkyd-melamine resin, and epoxy resin; and butyral resins such as polyvinyl butyral.

Preferably, the content of the binder resin is in the range of from 10 to 200 parts by mass, more preferably from 20 to 100 parts by mass, based on 100 parts by mass of the zinc oxide particle.

Salicylic Acid Derivative

Preferably, the undercoat layer includes a salicylic acid derivative.

As a salicylic acid derivative is added to an undercoat layer coating liquid, the zinc oxide particle gets coated with the salicylic acid derivative. When the zinc oxide particle has no surface coating, charge trap is likely to occur at the interface between the surface of the zinc oxide particle and the binder resin. As a result, the potential of the irradiated portion will be undesirably increased as the photoconductor is repeatedly used, causing an abnormal image density. In particular, charge trap easily occurs especially in high-temperature high-humidity environments to undesirably increase the potential of the irradiated portion, causing an abnormal image density. When the zinc oxide particle is coated with a salicylic acid, the above-described problems can be reduced.

Specific examples of the salicylic acid derivative include, but are not limited to, salicylic acid, acetylsalicylic acid, 5-acetylsalicylic acid, 3-aminosalicylic acid, 5-acetylsalicylamide, 5-aminosalicylic acid, 4-azidosalicylic acid, benzyl salicylate, 4-tert-butylphenyl salicylate, butyl salicylate, 3,5-di-t-butylsalicylic acid, 2-carboxyphenyl salicylate, 3,5-dinitorosalicylic acid, dithiosalicylic acid, ethyl acetylsalicylate, 2-ethylhexyl salicylate, ethyl 6-methylsalicylate, ethyl salicylate, 5-formylsalicylic acid, 4-(2-hydroxyethoxy)salicylic acid, 2-hydroxyethyl salicylate, isoamyl salicylate, isobutyl salicylate, isopropyl salicylate, 3-methoxysalicylic acid, 4-methoxysalicylic acid, 6-methoxysalicylic acid, methyl acetylsalicylate, methyl 5-acetylsalicylate, methyl 5-allyl-3-methoxysalicylate, methyl 5-formylsalicylate, methyl 4-(2-hydroxyethoxy) salicylate, methyl 3-methoxysalicylate, methyl 4-methoxysalicylate, methyl 5-methoxysalicylate, methyl 4-methylsalicylate, methyl 5-methylsalicylate, methyl salicylate, 3-methylsalicylic acid, 4-methylsalicylic acid, 5-methylsalicylic acid, methyl thiosalicylate, 4-nitrophenyl salicylate, 5-nitrosalicylic acid, 4-nitrosalicylic acid, 3-nitrosalicylic acid, 3,5-dinitrosalicylic acid, 4-octylphenyl salicylate, phenyl salicylate, 3-acetoxy-2-naphthanilide, 6-acetoxy-2-naphthoic acid, 3-amino-2-naphthoic acid, 6-amino-2-naphthoic acid, 1,4-dihydroxy-2-naphthoic acid, 3,5-dihydroxy-2-naphthoic acid, 3,7-dihydroxy-2-naphthoic acid, 2-ethoxy-1-naphthoic acid, 2-hydroxy-1-(2-hydroxy-4-sulfo-1-naphtylazo)-3-naphthoic acid, 3-hydroxy-7-methoxy-2-naphthoic acid, 1-hydroxy-2-naphthoic acid, 2-hydroxy-1-naphthoic acid, 3-hydroxy-2-naphthoic acid, 6-hydroxy-1-naphthoic acid, 6-hydroxy-2-naphthoic acid, 3-hydroxy-2-naphthoic acid hydrazide, 2-methoxy-1-naphthoic acid, 3-methoxy-2-naphthoic acid, 6-methoxy-2-naphthoic acid, methyl 6-amino-2-naphthoate, methyl 3-hydroxy-2-naphthoate, methyl 6-hydroxy-2-naphthoate, methyl 3-methoxy-2-naphthoate, phenyl 1,4-dihydroxy-2-naphthoate, and phenyl 1-hydroxy-2-naphthoate.

Each of these compounds can be used alone or in combination with others.

Preferably, the content rate of the salicylic acid derivative to the zinc oxide particle is in the range of from 0.01% to 10% by mass, more preferably from 0.1% to 5% by mass. When the content rate of the salicylic acid derivative to the zinc oxide particle is 0.01% by mass or more, the salicylic acid derivative can sufficiently exert its effect, thereby giving good properties to the photoconductor. When the content rate of the salicylic acid derivative to the salicylic acid derivative is 10% by mass or less, the salicylic acid derivative will not inhibit dispersion of the zinc oxide particle, thereby giving good properties to the photoconductor.

Other Components

The undercoat layer may further include other components for the purpose of improving electric property and image quality.

Specific examples of such components include, but are not limited to, electron transport materials; polycyclic condensed electron transport pigments and azo electron transport pigments; silane coupling agents; zirconium chelate compounds; titanium chelate compounds; aluminum chelate compounds; fluorenone compounds; titanium alkoxide compounds; organic titanium compounds; and antioxidants, plasticizers, lubricants, ultraviolet absorbers, and leveling agents. Each of these compounds can be used alone or in combination with others.

Method for Forming Undercoat Layer

The undercoat layer can be formed by a coating method. An undercoat layer coating liquid can be prepared by dissolving or dispersing the zinc oxide particle and the binder resin in a solvent. The binder resin may be mixed in the solvent either before or after the zinc oxide particle is dispersed in the solvent.

Specific examples of the solvent include, but are not limited to, alcohol solvents such as methanol, ethanol, propanol, and butanol; ketone solvents such as acetone, methyl ethyl ketone, methyl isobutyl ketone, and cyclohexanone; ester solvents such as ethyl acetate and butyl acetate; ether solvents such as tetrahydrofuran, dioxane, and propyl ether; halogen solvents such as dichloromethane, dichloroethane, trichloroethane, and chlorobenzene; aromatic solvents such as benzene, toluene, and xylene; and cellosolve solvents such as methyl cellosolve, ethyl cellosolve, and cellosolve acetate. Each of these solvents can be used alone or in combination with others.

The zinc oxide particle may be dispersed in the undercoat layer coating liquid with a ball mill, sand mill, vibration mill, KD mill, three roll mill, attritor, pressure homogenizer, or ultrasonic disperser.

The coating method is determined depending on the viscosity of the undercoat layer coating liquid and a desired average thickness of the resulting undercoat layer. Specific examples of the coating method include, but are not limited to, dipping coating, spray coating, bead coating, and ring coating.

After being coated on the support, the undercoat layer coating liquid may be heat-dried in an oven, if necessary. The drying temperature is determined depending on the solvent included in the undercoat layer coating liquid. Preferably, the drying temperature is in the range of from 80° C. to 200° C., and more preferably from 100° C. to 150° C.

The average thickness of the undercoat layer is determined depending on desired electric properties and/or lifespan of the photoconductor to be produced. Preferably, the undercoat layer has an average thickness of from 3 to 50 μm, and more preferably from 7 to 35 μm.

When the average thickness of the undercoat layer is 3 μm or more, charges having the opposite polarity to the charging polarity of the surface of the photoconductor will not be injected from the support to the photosensitive layer, thereby preventing defective image with background fog. When the average thickness of the undercoat layer is 50 μm or less, a decrease in light decay property (e.g., an increase in residual potential) or a decrease in repetitive stability is not likely to occur.

The average thickness of the undercoat layer can be determined by measuring the thickness at multiple randomly-selected portions on the undercoat layer and averaging the measured thickness values. Preferably, the multiple randomly-selected portions include 5 portions, more preferably 10 portions, and most preferably 20 portions. The above method for determining the average thickness of the undercoat layer can be applied to the other layers.

The thickness at each portion can be measured with a measuring instrument, such as a micrometer.

Photosensitive Layer

The photosensitive layer includes a compound represented by the following formula (1).

Formula (1)

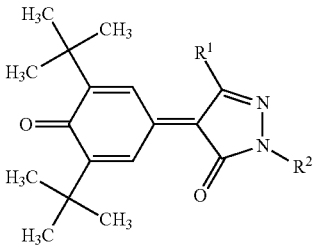

In the formula (1), each of $R^1$ and $R^2$ independently represents an alkyl group or an aromatic hydrocarbon group. Specific preferred examples of the alkyl group include alkyl groups having 1 to 4 carbon atoms. Specific preferred examples of the aromatic hydrocarbon group include phenyl group.

Examples of the alkyl group include both unsubstituted alkyl groups and alkyl groups substituted with a substituent. Examples of the aromatic hydrocarbon group include both unsubstituted aromatic hydrocarbon groups and aromatic hydrocarbon groups substituted with a substituent. Specific preferred examples of the substituent include halogens and alkyl groups having 1 to 4 carbon atoms.

The compound represented by the formula (1) is known to reduce light-induced fatigue and to improve electrostatic property and charge transportability. A photoconductor including the compound represented by the formula (1) in a charge transport layer has been proposed.

The inventors of the present invention have found that the combination of the above-described undercoat layer containing a zinc oxide particle and a binder resin with the photosensitive layer containing the compound represented by the formula (1) can drastically improve performance of the resulting photoconductor.

Specific examples of the compound represented by the formula (1) include, but are not limited to, example compounds 1-1 to 1-10 listed in the following Table 1.

TABLE 1

1-1

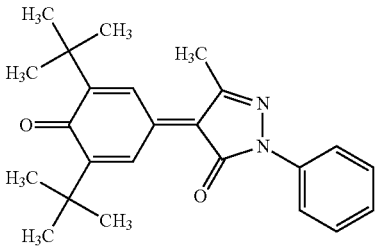

1-2

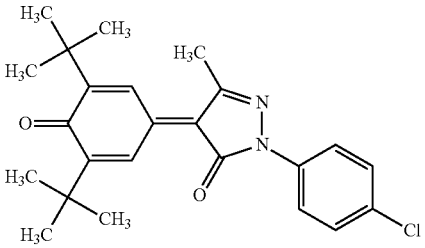

1-3

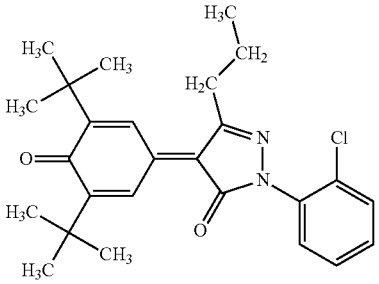

1-4

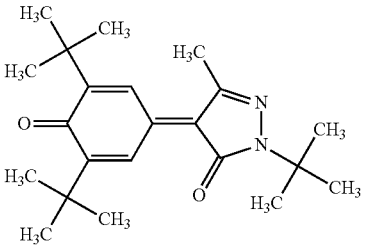

1-5

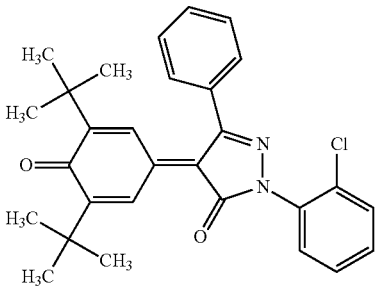

1-6

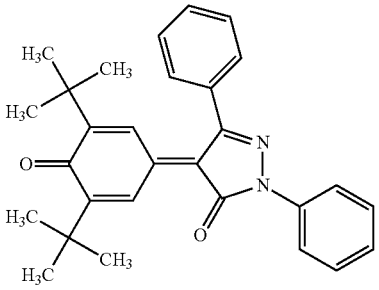

TABLE 1-continued

| | |
|---|---|
| 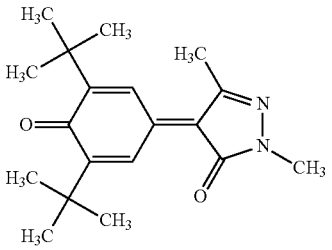 | 1-7 |
| 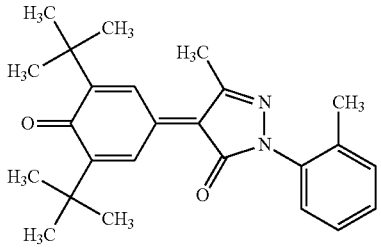 | 1-8 |
| 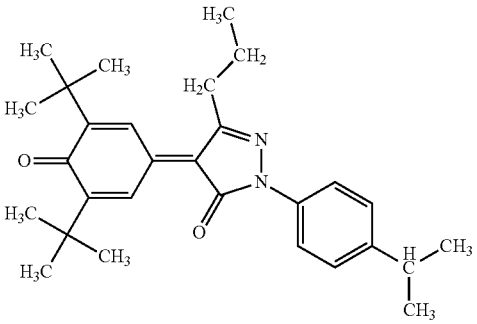 | 1-9 |
| 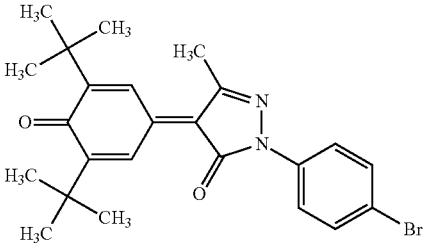 | 1-10 |

As described above, the photosensitive layer may be either a single-layer photosensitive layer (as illustrated in FIGS. 1 and 3) containing both a charge generation material and a charge transport material, or a multi-layer photosensitive layer (as illustrated in FIGS. 2 and 4) including a charge generation layer and a charge transport layer. First, the multi-layer photosensitive layer is described in detail below with reference to FIGS. 2 and 4.

With respect to the multi-layer photosensitive layer, the compound represented by the formula (1) may be included in at least one of the charge generation layer and the charge transport layer.

The compound represented by the formula (1) is capable of reducing light-induced fatigue and improving electrostatic property and charge transportability. The same effect can be obtained whether the compound represented by the formula (1) is included in one of or both of the charge generation layer and the charge transport layer. Preferably, the compound represented by the formula (1) is included in the charge transport layer.

Charge Generation Layer

The charge generation layer 35 includes a charge generation material as a main ingredient. Specific examples of the charge generation material in the charge generation layer 35 include, but are not limited to, monoazo pigments, disazo pigments, trisazo pigments, perylene pigments, perinone pigments, quinacridone pigments, quinone condensed polycyclic compounds, squaric acid dyes, phthalocyanine pigments, naphthalocyanine pigments, and azulenium salt dyes. Each of these charge generation materials can be used alone or in combination with others.

The charge generation layer 35 can be formed by applying a charge generation layer coating liquid on the undercoat layer, followed by drying. The charge generation layer coating liquid can be prepared by dispersing the charge generation material, optionally along with a binder resin, in a solvent, by a ball mill, an attritor, a sand mill, a bead mill, or an ultrasonic disperser.

Specific examples of the binder resin to be optionally used include, but are not limited to, polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose resins, casein, polyvinyl alcohol, and polyvinyl pyrrolidone. Preferably, the content of the binder resin is from 0 to 500 parts by mass, more preferably from 10 to 300 parts by mass, based on 100 parts by mass of the charge generation material. The binder resin may be added to the charge generation layer coating liquid either before or after the charge generation material is dispersed therein.

In a case in which the compound represented by the formula (1) is included in the charge generation layer 35, preferably, the content rate of the compound represented by the formula (1) in the charge generation layer 35 is from 0.1% to 15% by mass, more preferably from 0.3% to 5% by mass.

Specific examples of the solvent included in the charge generation layer coating liquid include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among these solvents, ketone solvents, ester solvents, and ether solvents are preferable. Each of these solvents can be used alone or in combination with others.

The charge generation layer coating liquid can be prepared by dispersing the charge generation material, optionally along with the binder resin, in the solvent, by a ball mill, an attritor, a sand mill, a bead mill, or an ultrasonic disperser. The charge generation layer coating liquid includes the charge generation material, the solvent, and the optional binder resin as main ingredients, and may further include additives such as an intensifier, a dispersant, a surfactant, and a silicone oil. The coating liquid may be coated by dipping coating, spray coating, bead coating, spinner coating, and ring coating.

Preferably, the charge generation layer 35 has a thickness of about 0.01 to 5 μm, more preferably 0.1 to 2 μm.

Charge Transport Layer

The charge transport layer 37 includes a charge transport material and a binder resin as main ingredients.

Examples of the charge transport material in the charge transport layer 37 include hole transport materials.

Specific examples of the hole transport materials include, but are not limited to, poly(N-vinylcarbazole) and derivatives thereof, poly(γ-carbazolyl ethylglutamate) and derivatives thereof, pyrene-formaldehyde condensates and derivatives thereof, polyvinylpyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, aminobiphenyl derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives.

Each of these charge transport materials can be used alone or in combination with others.

Specific examples of the binder resin include thermoplastic and thermosetting resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly (N-vinylcarbazole), acrylic resin, silicone resin, epoxy resin, melamine resin, urethane resin, phenol resin, and alkyd resin. Among these resins, polycarbonate and polyarylate are preferable.

Preferably, the content of the charge transport material is from 20 to 300 parts by mass, more preferably from 40 to 150 parts by mass, based on 100 parts by mass of the binder resin.

In a case in which the compound represented by the formula (1) is included in the charge transport layer 37, preferably, the content rate of the compound represented by the formula (1) in the charge transport layer 37 is from 0.1% to 10% by mass, more preferably from 0.3% to 5% by mass.

A charge transport material coating layer can be prepared by dissolving the charge transport material and the binder resin in a solvent. The coating liquid may be coated by dipping coating, spray coating, bead coating, spinner coating, and ring coating.

Specific examples of the solvent included in the coating liquid include, but are not limited to, tetrahydrofuran, dioxane, toluene, dichloromethane, monochlorobenzene, dichloroethane, cyclohexanone, methyl ethyl ketone, and acetone. Each of the solvents can be used alone or in combination with others.

Preferably, the charge transport layer 37 has a thickness of 50 μm or less, more preferably 25 μm or less, from the aspect of resolution and responsiveness. Depending on the system (in particular, charge potential) in use, preferably, the lower limit of the thickness of the charge transport layer 37 is 5 μm or more.

Next, the single-layer photosensitive layer is described in detail below with reference to FIGS. 1 and 3.

The photosensitive layer 33 can be formed by application of a photosensitive layer coating liquid, followed by drying. The photosensitive layer coating liquid can be prepared by dissolving or dispersing a charge generation material, a charge generation material, and a binder resin in a solvent. The coating liquid may further include a plasticizer, a leveling agent, and/or an antioxidant.

Specific examples of the charge generation material, charge transport material, and binder resin in the photosensitive layer 33 include those exemplified for the charge generation layer 35 and the charge transport layer 37 above.

Preferably, the photosensitive layer 33 further includes an electron transport material in combination with the charge transport material, for more improving sensitivity.

Specific examples of the electron transport material include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives.

Preferably, the content rate of the charge generation material in the photosensitive layer 33 is from 0.1% to 30% by mass, more preferably from 0.5% to 5% by mass. As the charge generation material concentration decreases, sensitivity of the photoconductor may deteriorate. As the charge generation material concentration increases, chargeability and film strength of the photoconductor may deteriorate.

Preferably, the content rate of the compound represented by the formula (1) in the photosensitive layer 33 is from 0.1% to 10% by mass, more preferably from 0.3% to 5% by mass.

Preferably, the photosensitive layer 33 has a thickness of 50 μm or less, more preferably 25 μm or less, from the aspect of resolution and responsiveness.

Depending on the system (in particular, charge potential) in use, preferably, the lower limit of the thickness of the photosensitive layer 33 is 5 μm or more.

Protective Layer

The photoconductor may further include the protective layer 39 overlying the photosensitive layer, for protecting the photosensitive layer.

Preferably, the protective layer 39 includes a cross-linked resin and/or a filler to have high abrasion resistance.

A protective layer including a cross-linked resin can be formed by reacting a radical polymerizable monomer with a radical polymerizable compound having a charge transport structure to cure them into a three-dimensional network structure. The resulting protective layer has high degrees of cross linkage and hardness.

Preferably, the protective layer 39 includes a filler, for improving mechanical durability. More preferably, the protective layer 39 includes both a cross-linked resin and a filler, for more improving abrasion resistance and extending the lifespan of the photoconductor.

Specific examples of the filler include, but are not limited to, titanium oxide, tin oxide, zinc oxide, zirconium oxide, indium oxide, antimony oxide, boron nitride, silicon nitride, calcium oxide, barium sulfate, ITO (indium tin tin oxide), silicon oxide, colloidal silica, and aluminum silica. Among these materials, aluminum oxide, titanium oxide, silicon oxide, and tin oxide are preferred from the aspect of electric property of the protective layer.

Preferably, the filler has an average primary particle diameter in the range of from 0.01 to 0.5 μm from the aspect of light transmittivity and abrasion resistance of the protective layer. When the average primary particle diameter of the filler is 0.01 μm or more, neither abrasion resistance nor dispersibility deteriorate. When the average primary particle diameter of the filler is 0.5 μm or less, the surface roughness of the protective layer does not excessively increase, thus suppressing a cleaning blade (to be described later) from wearing rapidly. When the average primary particle diameter of the filler is within the above-described range, toner particles remaining on the photoconductor can be easily removed, and the filler particles are not likely to precipitate in a dispersion liquid depending on the specific weight.

The concentration of the filler in all the solid contents is 50% by mass or less, preferably 30% by mass or less. As the concentration of the filler increases, abrasion resistance improves. However, when the concentration of the filler exceeds 50% by mass, residual potential may increase and/or transmittivity may decrease due to the occurrence of writing light scattering in the protective layer.

Image Forming Method and Image Forming Apparatus

An image forming method according to an embodiment of the present invention includes the processes of charging a surface of the photoconductor according to an embodiment of the present invention, irradiating the charged surface of the photoconductor with light to form an electrostatic latent image thereon, developing the electrostatic latent image into a toner image, and transferring the toner image onto a recording medium. The method may further include the processes of fixing the toner image on the recording medium and cleaning the surface of the photoconductor.

An image forming apparatus according to an embodiment of the present invention includes: the photoconductor according to an embodiment of the present invention; a charger configured to charge a surface of the photoconductor; an irradiator configured to irradiate the charged surface of the photoconductor with light to form an electrostatic latent image thereon; a developing device configured to develop the electrostatic latent image into a toner image; and a transfer device configured to transfer the toner image onto a recording medium. The apparatus may further include a fixing device configured to fix the toner image on the recording medium and a cleaner configured to clean the surface of the photoconductor. The image forming apparatus may include a plurality of sets of image forming elements including the charger, the irradiator, the developing device, the transfer device, and the photoconductor.

Figure 5:
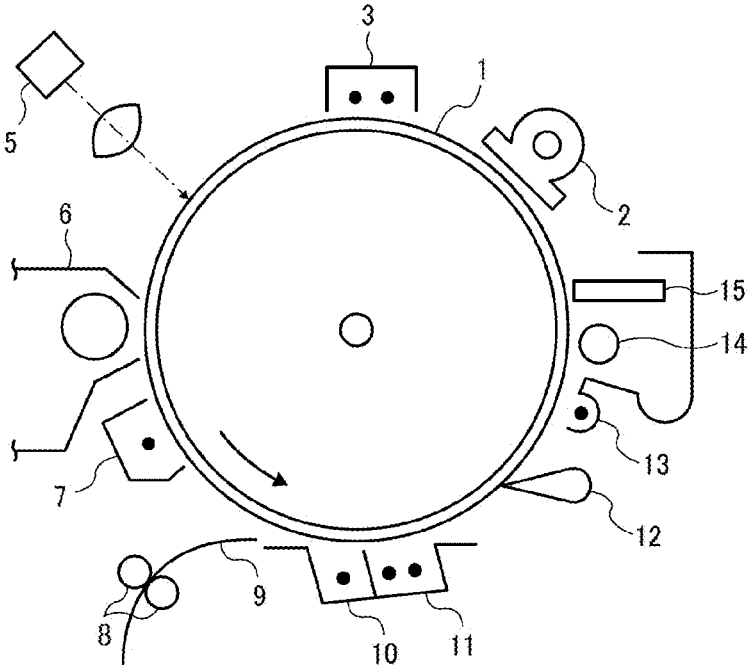
FIG. 5 is a schematic view of an image forming apparatus according to an embodiment of the present invention.

FIG. 5 is a schematic view of an image forming apparatus according to an embodiment of the present invention.

Referring to FIG. 5, a charger 3 is configured to charge a photoconductor 1. Specific examples of the charger 3 include, but are not limited to, a corotron device, a scorotron device, a solid-state discharging element, a multi-stylus electrode, a roller charging device, and a conductive brush device. In particular, contact chargers or closely-arranged non-contact chargers can be used that cause electric discharge near the photoconductor. The contact chargers refer to chargers that come into direct contact with the photoconductor, such as a charging roller, a charging brush, and a charging blade. The closely-arranged non-contact chargers refer to chargers arranged not in contact with but close to the photoconductor with a gap of 200 μm therebetween. If the gap is too large, the charge of the photoconductor will become unstable. If the gap is too small, in a case in which residual toner particles are remaining on the photoconductor, the surface of the charger will be contaminated with the residual toner particles. Thus, the gap is set within the range of from 10 to 200 μm, preferably from 10 to 100 μm.

Next, an irradiator 5 emits light to the charged photoconductor 1 to form an electrostatic latent image thereon. The irradiator 5 includes a light source. Examples of the light source include all luminous matters such as fluorescent lamp, tungsten lamp, halogen lamp, mercury lamp, sodium-vapor lamp, light-emitting diode (LED), laser diode (LD), and electroluminescence (EL). For the purpose of emitting light having a desired wavelength only, any type of filter can be used, such as sharp cut filter, band pass filter, near infrared cut filter, dichroic filter, interference filter, and color-temperature conversion filter.

Next, a developing unit 6 develops the electrostatic latent image formed on the photoconductor 1 into a toner image by a known developing method, such as a one-component developing method and a two-component developing method each using dry toner, and a wet drying method using wet toner. In the case of reversal development, as the photoconductor 1 is negatively charged and thereafter irradiated with light, a positive electrostatic latent image is formed on the surface of the photoconductor 1. When the positive electrostatic latent image is developed with a negative-polarity toner, a positive image is obtained. By contrast, when the positive electrostatic latent image is developed with a positive-polarity toner, a negative image is obtained.

In the case of normal development, a negative electrostatic latent image is formed on the photoconductor 1. When the negative electrostatic latent image is developed with a positive-polarity toner, a positive image is obtained. By contrast, when the negative electrostatic latent image is developed with a negative-polarity toner, a negative image is obtained.

Next, a transfer charger 10 transfers the toner image from the photoconductor 1 onto a transfer medium 9. For the purpose of improving transfer efficiency, a pre-transfer charger 7 may be used in combination with the transfer charger 10. The transfer charger 10 may employ any transfer method, such as an electrostatic transfer method using a transfer charger or a bias roller; a mechanical transfer method such as an adhesive transfer method and a pressure transfer method; or a magnetic transfer method. In the electrostatic transfer method, the above-described charger can be used.

Next, a separation charger 11 and a separation claw 12 separate the transfer medium 9 from the photoconductor 1. The separation may also be performed by means of electrostatic adsorption induction separation, side-end belt separation, leading-end grip conveyance, or curvature separation. As the separation charger 11, the above-described charger can be used.

Next, a fur brush 14 and a cleaning blade 15 remove residual toner particles remaining on the photoconductor 1 without being transferred, thus cleaning up the photoconductor 1.

For the purpose of improving cleaning efficiency, a pre-cleaning charger 13 may be used in combination. The cleaning may also be performed by a web cleaner or a magnetic brush cleaner. Such cleaners can be used alone or in combination with others.

Optionally, a neutralizer removes residual latent images remaining on the photoconductor 1 thereafter. Specific examples of the neutralizer include, but are not limited to, a neutralization lamp 2 and a neutralization charger. As the neutralization lamp 2 and the neutralization charger, the above-described light source and charger, respectively, can be used. Processes that are performed away from the photoconductor 1, such as document reading, paper feeding, fixing, paper ejection, can be performed by known means.

As described above, the image forming apparatus according to an embodiment of the present invention includes image forming members including the photoconductor according to an embodiment of the present invention. The image forming members may be built in a copier, a facsimile machine, or a printer. Alternatively, the image forming members may be integrated into a process cartridge that is detachably mountable thereon.

Process Cartridge

A process cartridge according to an embodiment of the present invention includes: the according to an embodiment of the present invention; and at least one of a charger configured to charge a surface of the photoconductor, an irradiator configured to irradiate the charged surface of the photoconductor with light to form an electrostatic latent image thereon, a developing device configured to develop the electrostatic latent image into a toner image, and a transfer device configured to transfer the toner image onto a recording medium. The process cartridge is detachably mountable on an image forming apparatus body. The process cartridge may further include other members such as a cleaner and a neutralizer.

Figure 6:
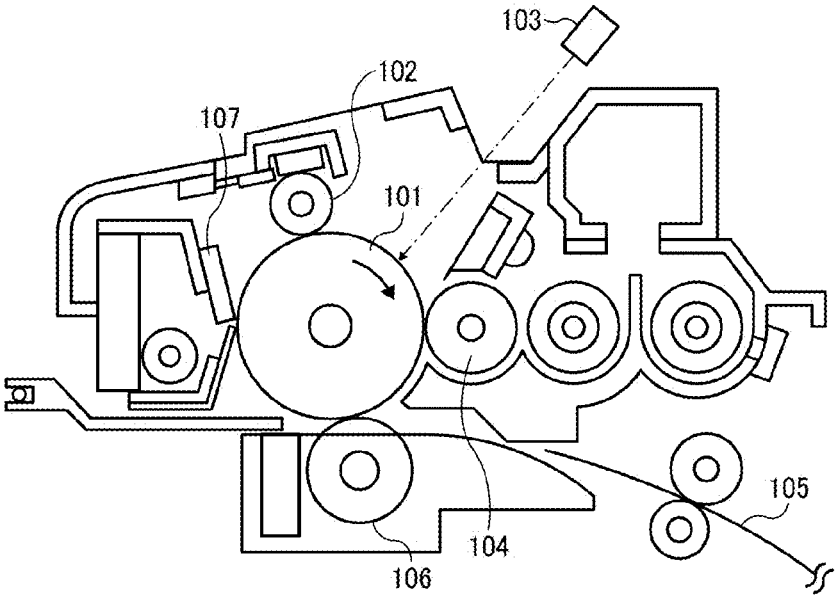
FIG. 6 is a schematic view of a process cartridge according to an embodiment of the present invention.

FIG. 6 is a schematic view of a process cartridge according to an embodiment of the present invention.

The process cartridge includes a photoconductor 101 according to an embodiment of the present invention, a charger 102, a developing device 104, a transfer device 106, a cleaner 107, and a neutralizer. The process cartridge is detachably mountable on an image forming apparatus body. While the photoconductor 101 is rotating in a direction indicated by arrow in FIG. 6, the charger 102 charges a surface of the photoconductor 101 and an irradiator 103 emits light to the charged surface of the photoconductor 101, to form an electrostatic latent image on the surface of the photoconductor 101. The developing device 104 develops the electrostatic latent image into a toner image. The transfer device 106 transfers the toner image onto a transfer medium 105. The transfer medium 105 having the toner image thereon is printed out. After the toner image has been transferred onto the transfer medium 105, the cleaner 107 cleans the surface of the photoconductor 101 and the neutralizer neutralizes the surface of the photoconductor 101. These operations are repeatedly performed.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts, unless otherwise specified.

Example 1

An aluminum support (having an outer diameter of 100 mm) was coated with an undercoat layer coating liquid having the following composition by dip coating and dried at 170° C. for 30 minutes. The resulting undercoat layer had a thickness of 20 μm.

Zinc oxide particle (MZ-300 available from Tayca Corporation, having an average particle diameter of 35 μm): 350 parts Salicylic acid derivative: 3,5-di-t-Butylsalicylic acid (TCI-D1947 available from Tokyo Chemical Industry Co., Ltd.): 1.5 parts Binder resin: Blocked isocyanate (SUMIDUR BL3175 available from Sumika Bayer Urethane Co., Ltd., having a solid content of 75% by weight): 60 parts Binder resin: 2-Butanone-diluted solution (20% by weight) of butyral resin (BM-S available from Sekisui Chemical Co., Ltd.): 225 parts Solvent: 2-Butanone: 105 parts The undercoat layer was coated with a charge generation layer coating liquid by dip coating and dried at 90° C. for 20 minutes. The resulting charge generation layer had a thickness of 0.2 μm.

The charge generation layer coating liquid was prepared by mixing the below-listed materials with a bead mill filled with glass beads having a diameter of 1 mm for 8 hours.

Titanyl phthalocyanine: 8 parts

Polyvinyl butyral (BX-1 available from Sekisui Chemical Co., Ltd.): 5 parts

2-Butanone: 400 parts

The charge generation layer was coated with a charge transport layer coating liquid by dip coating and dried at 120° C. for 20 minutes. The resulting charge transport layer had a thickness of 25 μm.

The charge transport layer coating liquid was prepared by mixing the below-listed materials with a stirrer for 3 hours until all the materials had been dissolved.

Z-type Polycarbonate (TS-2050 available from Teijin Chemicals Ltd.): 10 parts

Charge transport material having the following formula (i): 10 parts

Formula (i)

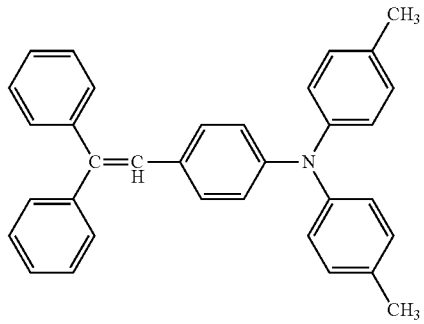

Example compound 1-3 (as the compound represented by the formula (1)): 0.3 parts Tetrahydrofuran: 100 parts The charge transport layer was coated with a protective layer coating liquid by spray coating, exposed to light emitted from a metal halide lamp (at an emission intensity of 500 mW/cm$^2$ for an emission time of 160 seconds), and dried at 130° C. for 30 minutes. The resulting protective layer had a thickness of 4.0 μm. Thus, a photoconductor of Example 1 was prepared.

The protective layer coating liquid was prepared by mixing the below-listed materials with a stirrer for 3 hours until all the materials had been dissolved.

Radical polymerizable monomer (Trimethylolpropane acrylate, KAYARAD TMPTA available from Nippon Kayaku Co., Ltd.): 10 parts Compound having the following formula (ii): 10 parts Formula (ii)

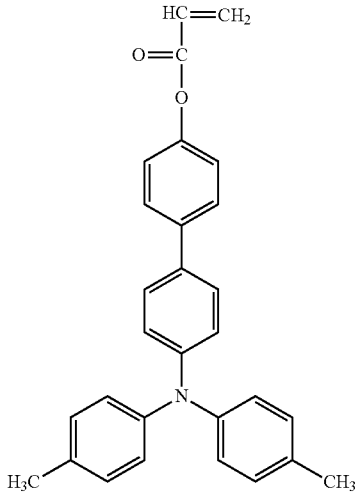

Photopolymerization initiator (IRGACURE 184 available from Ciba Specialty Chemicals Inc.): 1 part
Tetrahydrofuran: 100 parts Example 2

The procedure in Example 1 was repeated except for changing the composition of the undercoat layer as follows.
Zinc oxide particle (MZ-300 available from Tayca Corporation, having an average particle diameter of 35 μm): 350 parts
Binder resin: Blocked isocyanate (SUMIDUR BL3175 available from Sumika Bayer Urethane Co., Ltd., having a solid content of 75% by weight): 60 parts
Binder resin: 2-Butanone-diluted solution (20% by weight) of butyral resin (BM-S available from Sekisui Chemical Co., Ltd.): 225 parts
Solvent: 2-Butanone: 105 parts Example 3

The procedure in Example 1 was repeated except for changing the dip coating speed in coating the undercoat layer coating liquid, such that the thickness of the undercoat layer became 7 μm after being dried at 170° C. for 30 minutes.

Example 4

The procedure in Example 1 was repeated except for changing the dip coating speed in coating the undercoat layer coating liquid, such that the thickness of the undercoat layer became 5 μm after being dried at 170° C. for 30 minutes.

Example 5

The procedure in Example 1 was repeated except for changing the dip coating speed in coating the undercoat layer coating liquid, such that the thickness of the undercoat layer became 35 μm after being dried at 170° C. for 30 minutes.

Example 6

The procedure in Example 1 was repeated except for changing the dip coating speed in coating the undercoat layer coating liquid, such that the thickness of the undercoat layer became 45 μm after being dried at 170° C. for 30 minutes.

Example 7

The procedure in Example 1 was repeated except for changing the compositions of the charge generation layer coating liquid and the charge transport layer coating liquid as follows.
Charge Generation Layer Coating Liquid
Titanyl phthalocyanine: 8 parts
Polyvinyl butyral (BX-1 available from Sekisui Chemical Co., Ltd.): 5 parts
Example compound 1-9 (as the compound represented by the formula (1)): 0.5 parts
2-Butanone: 400 parts
Charge Transport Layer Coating Liquid
Z-type Polycarbonate (TS-2050 available from Teijin Chemicals Ltd.): 10 parts
Charge transport material having the formula (i): 10 parts
Tetrahydrofuran: 100 parts Example 8

The procedure in Example 1 was repeated except for changing the compositions of the charge generation layer coating liquid and the charge transport layer coating liquid as follows.
Charge Generation Layer Coating Liquid
Titanyl phthalocyanine: 8 parts
Polyvinyl butyral (BX-1 available from Sekisui Chemical Co., Ltd.): 5 parts
Example compound 1-6 (as the compound represented by the formula (1)): 0.5 parts
2-Butanone: 400 parts
Charge Transport Layer Coating Liquid
Z-type Polycarbonate (TS-2050 available from Teijin Chemicals Ltd.): 10 parts
Charge transport material having the formula (i): 10 parts
Example compound 1-6 (as the compound represented by the formula (1)): 0.3 parts
Tetrahydrofuran: 100 parts Example 9

The procedure in Example 1 was repeated except for changing the compositions of the undercoat layer coating liquid and the charge transport layer coating liquid as follows.
Undercoat Layer Coating Liquid
Zinc oxide particle (MZ-300 available from Tayca Corporation, having an average particle diameter of 35 μm): 350 parts
Salicylic acid derivative: 3-Aminosalicylic acid (available from Tokyo Chemical Industry Co., Ltd.): 1.5 parts
Binder resin: Blocked isocyanate (SUMIDUR BL3175 available from Sumika Bayer Urethane Co., Ltd., having a solid content of 75% by weight): 60 parts
Binder resin: 2-Butanone-diluted solution (20% by weight) of butyral resin (BM-S available from Sekisui Chemical Co., Ltd.): 225 parts
Solvent: 2-Butanone: 105 parts Charge Transport Layer Coating Liquid Z-type Polycarbonate (TS-2050 available from Teijin Chemicals Ltd.): 10 parts Charge transport material having the formula (i): 10 parts Example compound 1-7 (as the compound represented by the formula (1)): 0.3 parts Tetrahydrofuran: 100 parts Example 10

The procedure in Example 1 was repeated except for changing the compositions of the undercoat layer coating liquid and the charge transport layer coating liquid as follows.

Undercoat Layer Coating Liquid

Zinc oxide particle (MZ-300 available from Tayca Corporation, having an average particle diameter of 35 μm): 350 parts Salicylic acid derivative: 3-Dinitrosalicylic acid (available from Tokyo Chemical Industry Co., Ltd.): 1.5 parts Binder resin: Blocked isocyanate (SUMIDUR BL3175 available from Sumika Bayer Urethane Co., Ltd., having a solid content of 75% by weight): 60 parts Binder resin: 2-Butanone-diluted solution (20% by weight) of butyral resin (BM-S available from Sekisui Chemical Co., Ltd.): 225 parts Solvent: 2-Butanone: 105 parts Charge Transport Layer Coating Liquid Z-type Polycarbonate (TS-2050 available from Teijin Chemicals Ltd.): 10 part Charge transport material having the formula (i): 10 parts Example compound 1-1 (as the compound represented by the formula (1)): 0.3 parts Tetrahydrofuran: 100 parts Comparative Example 1

The procedure in Example 1 was repeated except for replacing the example compound 1-3 (as the compound represented by the formula (1)) in the charge transport layer coating liquid with a compound having the following formula (iii) used for the same purpose as the compound represented by the formula (1).

Formula (iii)

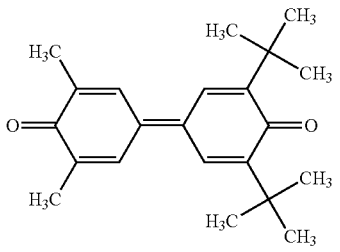

Comparative Example 2

The procedure in Example 1 was repeated except for replacing the example compound 1-3 (as the compound represented by the formula (1)) included in the charge transport layer coating liquid with a compound having the following formula (iv) used for the same purpose as the compound represented by the formula (1).

Formula (iv)

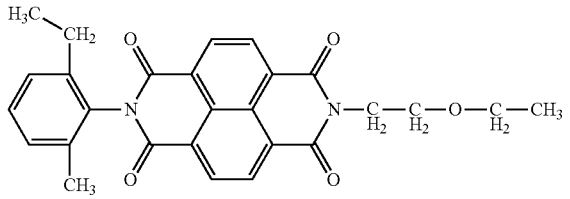

Comparative Example 3

The procedure in Example 1 was repeated except for eliminating the example compound 1-3 from the charge transport layer coating liquid.

Comparative Example 4

The procedure in Example 1 was repeated except for replacing the zinc oxide particle included in the undercoat layer with the following material.

Titanium oxide particle (MT-500B available from Tayca Corporation, having an average particle diameter of 35 μm)

Comparative Example 5

The procedure in Example 1 was repeated except for replacing the zinc oxide particle included in the undercoat layer with the following material.

Tin oxide (Nano Tek® $SnO_2$ available from C. I. Kasei Company, Limited, having an average particle diameter of 21 μm)

Evaluation of Electric Properties and Image Quality (Electrophotographic Properties) Evaluation Apparatus A digital copier (PRO C900 available from Ricoh Co., Ltd.) that had been modified to include a scorotron charger (equipped with a discharge wire made of gold-plated tungsten-molybdenum alloy having a diameter of 50 μm), an irradiator (equipped with a light source emitting laser light having a wavelength of 780 nm and a polygon mirror for writing images at a resolution of 1,200 dpi), a black two-component developer, a transfer belt, and a neutralization lamp, was used as an evaluation apparatus.

Photoconductor Deterioration Test

A deterioration test was performed by continuously printing a 5% chart (i.e., an A4-size chart on which average texts were drawn at an image rate of 5%) on 500,000 sheets.

The deterioration test was performed in three different environments: a low-temperature low-humidity (LL) environment having a temperature of 10° C. and a relative humidity of 15%; a normal-temperature normal-humidity (MM) environment having a temperature of 23° C. and a relative humidity of 55%; and a high-temperature high-humidity (HH) environment having a temperature of 27° C. and a relative humidity of 80%. Before and after each deterioration test, a short-time fluctuation in potential of the irradiated portion was evaluated. In addition, after each deterioration test, image quality (the degrees of background fog and residual image) was evaluated.

Short-Term Fluctuation in Potential of Irradiated Portion

The developing unit of the digital copier was modified to be equipped with a potential sensor.

After adjusting a current impressed to the discharge wire to −1,800 μA and a grid voltage to −800 V, a solid image was printed on 100 sheets of A3-size paper in a portrait direction. The potential of the irradiated portion (VL) was measured at the time of printing the 1st and 100th sheets. The potential was measured with a surface potentiometer (Model 344 available from TREK Japan KK). Surface potential values were recorded by an oscilloscope at a rate of 100 signals or more per second.

Evaluation Criteria for short-term fluctuation in potential of the irradiated portion (VL) were as follows.

A: The difference in potential of the irradiated portion between the 1 st and 100th sheets was less than 10 V B: The difference in potential of the irradiated portion between the 1 st and 100th sheets was less than 30 V and not less than 10V.

C: The difference in potential of the irradiated portion between the 1 st and 100th sheets was 30V or more.

Evaluation of Image Quality

Evaluation of Background Fog

White solid image was continuously printed on 5 sheets of a gloss-coated paper. On the printed sheets, ten randomly-selected rectangular areas with sides having lengths of 8 mm and 11 mm were visually observed to count the number of visible background fogs in each area. The counted numbers were averaged and evaluated based on the following criteria.

A: The average number of background fogs was not greater than 10.

B: The average number of background fogs was greater than 10 but not greater than 20.

C: The average number of background fogs was greater than 20.

Evaluation of Residual Image

Figure 7:
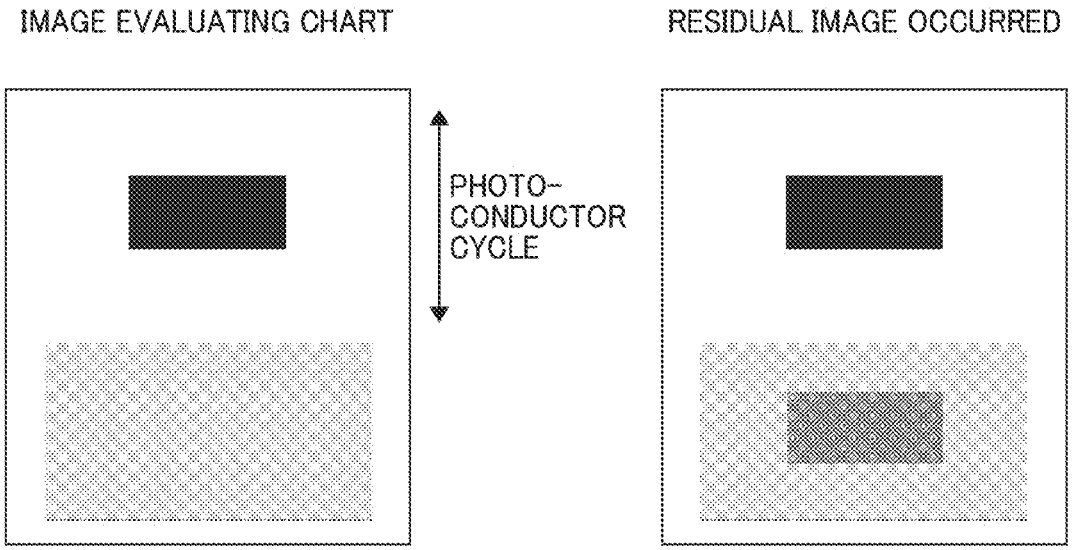
FIG. 7 is an illustration of an image evaluating chart used for evaluating photoconductors.

An image evaluating chart illustrated in FIG. 7 was printed out and the halftone part was visually observed to evaluate the degree of residual image based on the following criteria.

A: No residual image was observed.

B: A residual image was observed, but no problem in practical use.

C: A residual image was clearly observed.

The evaluation results are shown in Table 2.

TABLE 2

| | Short-term Fluctuation in VL before Deterioration Test | | | Short-term Fluctuation in VL after Deterioration Test | | | Image Evaluation after Deterioration Test | | | | | |
|---|---|---|---|---|---|---|---|---|---|---|---|---|
| | | | | | | | Background Fog | | | Residual Image | | |
| | LL | MM | HH | LL | MM | HH | LL | MM | HH | LL | MM | HH |
| Example 1 | A | A | A | B | A | A | A | A | A | B | A | A |
| Example 2 | B | A | A | B | A | B | B | A | B | B | A | A |
| Example 3 | B | A | A | B | A | A | B | A | B | B | B | A |
| Example 4 | B | A | A | B | A | A | B | B | B | B | B | A |
| Example 5 | B | A | A | B | B | B | B | A | A | B | A | B |
| Example 6 | B | A | A | B | B | B | B | A | A | B | B | B |
| Example 7 | B | A | A | B | A | A | A | A | A | B | B | A |
| Example 8 | B | A | A | A | A | A | A | A | A | B | A | A |
| Example 9 | A | A | A | B | A | A | A | A | B | B | A | B |
| Example 10 | A | A | A | B | A | B | A | A | B | A | A | B |
| Comparative Example 1 | B | B | A | C | C | B | B | A | B | C | B | B |
| Comparative Example 2 | B | B | B | C | C | C | A | A | B | C | B | B |
| Comparative Example 3 | B | A | B | C | B | B | A | A | A | C | B | B |
| Comparative Example 4 | B | B | B | B | B | C | B | B | B | C | B | C |
| Comparative Example 5 | B | B | A | C | B | A | B | B | C | B | B | B |

The evaluation results indicate that the photoconductors according to some embodiments of the present invention reliably provide stable electric properties and image quality for an extended period of time even in high-temperature high-humidity environments or low-temperature low-humidity environments.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A photoconductor comprising:

a support;

an undercoat layer overlying the support, the undercoat layer comprising a binder resin, a zinc oxide particle, and a salicylic acid derivative; and a photosensitive layer overlying the undercoat layer, the photosensitive layer comprising a compound represented by the following formula (1):

Formula (1)

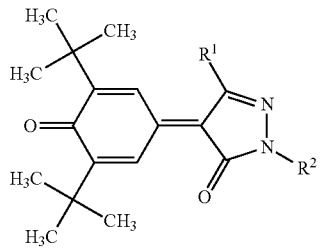

where each of $R^1$ and $R^2$ independently represents an alkyl group or an aromatic hydrocarbon group.

2. The photoconductor of claim 1, wherein the undercoat layer has a thickness of from 7 to 35 μm.

3. An image forming apparatus comprising:

the photoconductor of claim 1;

a charger configured to charge a surface of the photoconductor;

an irradiator configured to irradiate the charged surface of the photoconductor with light to form an electrostatic latent image thereon;

a developing device configured to develop the electrostatic latent image into a toner image; and a transfer device configured to transfer the toner image onto a recording medium.

4. A process cartridge comprising:

the photoconductor of claim 1; and at least one of a charger, an irradiator, a developing device, and a transfer device.

wherein:

the charger is configured to charge a surface of the photoconductor;

the irradiator is configured to irradiate the charged surface of the photoconductor with light to form an electrostatic latent image thereon;

the developing device is configured to develop the electrostatic latent image into a toner image; and the transfer device is configured to transfer the toner image onto a recording medium.

5. The photoconductor according to claim 1, wherein a content of the salicylic acid derivative to the zinc oxide particle in the undercoat layer is in a range of from 0.1% to 5% by mass.

6. The photoconductor according to claim 1, wherein the zinc oxide particle has an average particle diameter within a range of from 20 to 200 nm.

7. The photoconductor according to claim 1, wherein a volume occupancy of the zinc oxide particle in the undercoat layer is in a range of from 40% to 55%.

8. The photoconductor according to claim 1, wherein a content of the binder resin in the undercoat layer is in a range of from 20 to 100 parts by mass based on 100parts by mass of the zinc oxide particle.

* * * * *